US006736063B2

(12) United States Patent
Murata

(10) Patent No.: US 6,736,063 B2
(45) Date of Patent: May 18, 2004

(54) PRINTING APPARATUS

(75) Inventor: Akira Murata, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 0 days.

(21) Appl. No.: 10/461,385

(22) Filed: Jun. 16, 2003

(65) Prior Publication Data

US 2003/0233951 A1 Dec. 25, 2003

(30) Foreign Application Priority Data

Jun. 24, 2002 (JP) ..... 2002-182724

(51) Int. Cl.[7] ..... B41F 13/24; B41F 16/00; B41N 3/00

(52) U.S. Cl. ..... 101/247; 101/142; 101/144; 101/401.1; 101/135; 101/177; 101/216; 101/477; 101/465; 101/466; 101/467; 101/218; 101/182; 101/184; 101/185; 101/191; 101/192

(58) Field of Search ..... 101/144, 142, 101/401.1, 135, 177, 216, 477, 465, 466, 467, 145, 218, 182, 184, 185, 191, 192, 247

(56) References Cited

U.S. PATENT DOCUMENTS 5,690,029 A * 11/1997 Herrmann et al. ..... 101/218
6,009,807 A 1/2000 Yoshida et al.
6,138,566 A * 10/2000 Sakamoto ..... 101/463.1
6,302,018 B1 10/2001 Aoyama et al.
6,327,975 B1 * 12/2001 Izawa ..... 101/170
6,668,721 B2 * 12/2003 Naka ..... 101/218

FOREIGN PATENT DOCUMENTS

| | | |
|---|---|---|
| EP | 0 867 279 | 9/1998 |
| GB | 2 293 794 | 4/1996 |
| JP | 8-118591 | 5/1996 |
| JP | 10-272756 | 10/1998 |
| JP | 11-058671 | 3/1999 |
| JP | 10-323963 | 12/1999 |
| JP | 2000-280439 | 10/2000 |
| JP | 2001-30459 | 2/2001 |
| JP | 2001-030461 | 2/2001 |
| JP | 2001-096712 | 4/2001 |
| JP | 2001-113669 | 4/2001 |

* cited by examiner

*Primary Examiner*—Andrew H. Hirshfeld
*Assistant Examiner*—Marvin P Crenshaw
(74) *Attorney, Agent, or Firm*—McDermott, Will & Emery

(57) ABSTRACT

At printing time, a blanket cylinder gear is meshed with a plate cylinder gear, whereby a first plate cylinder is rotatable by a drive motor. At image-recording time, the blanket cylinder gear is separated from the plate cylinder gear. In this state, a different motor drives the plate cylinder gear to rotate the first plate cylinder at low speed.

7 Claims, 10 Drawing Sheets

PRINTING APPARATUS

BACKGROUND OF THE INVENTION

1. Field of the Invention

This invention relates to a printing apparatus for making a printing plate by recording an image on the plate, and thereafter printing the image by feeding ink to the plate.

2. Description of the Related Art

In an ordinary conventional printing apparatus, a prepress process is carried out first to make a printing plate by exposing the plate placed in contact with a film having a binary black and white image recorded thereon. Then, the plate is loaded into the printing apparatus to carry out a printing process.

Recently, printing apparatus commonly called digital printers have been proposed, one such printer being capable of performing both the prepress process and printing process. The digital printers employ a "computer-to-plate" system for forming an image on a printing plate by directly scanning and exposing the plate with laser beams or the like modulated with image signals.

In such a printing apparatus of the plate cylinder moving type, a plate cylinder having a printing plate mounted peripherally thereof must be rotated at a fixed rate in order for an image recording device to record an image on the plate. In an ordinary printing apparatus, generally, the plate cylinder has a cylinder gear disposed coaxially therewith to be rotatable by drive transmitted from a different cylinder. Thus, by using a drive system of such a printing apparatus to rotate the plate cylinder, an image may be recorded on the printing plate mounted peripherally of the plate cylinder.

Japanese Unexamined Patent Publication No. 2001-96712 discloses a printing apparatus employing a construction for rotating a plate cylinder by using the drive system of the printing apparatus at platemaking time. At this time, mechanical vibrations and load variations are avoided by operating a clutch to isolate loads of the drive system applied by a swing mechanism, paper gripping mechanism, ink feeding mechanism and the like.

When the image recording device records an image on the printing plate, the plate cylinder having a printing plate mounted peripherally thereof must be rotated at low speed and with a high degree of accuracy. When the drive system in the printing apparatus is utilized at this time as noted above, an inverter motor used in such drive system can rotate the plate cylinder at high speed, but is accompanied by considerable variations in the rotational accuracy. This baffles a high-accuracy image recording.

On the other hand, Japanese Unexamined Patent Publication No. 11-58671 (1999) discloses a printing apparatus in which, at platemaking time, a plate cylinder is moved from a printing position to a platemaking position, and then an image is recorded while rotating the plate cylinder by using a rotating mechanism of the traction type different from the drive system of the printing apparatus. This apparatus can avoid rotational variations of the plate cylinder to record the image with high precision, but requires a complicated construction for obtaining reproducibility of the position of the plate cylinder. Another disadvantage of the apparatus is that the movement of the plate cylinder is a time-consuming operation.

Japanese Unexamined Patent Publication No. 2000-280439 discloses a printing apparatus having a clutch provided between a plate cylinder gear and a plate cylinder. At platemaking time, the clutch is operated to break drive transmission between the plate cylinder and the drive system of the printing apparatus, and then an image is recorded while rotating the plate cylinder by using a motor other than a motor in the drive system of the printing apparatus. This apparatus can avoid rotational variations of the plate cylinder to record the image with high precision, but causes a misregistration due to a phase shift of the clutch at printing time. This poses a problem of requiring an additional device for attaining registration in the longitudinal direction.

SUMMARY OF THE INVENTION

The object of this invention is to provide a printing apparatus having a simple construction and yet capable of recording and printing images with high precision.

The above object is fulfilled, according to this invention, by a printing apparatus comprising a plate cylinder for supporting a printing plate as mounted peripherally thereof; a blanket cylinder having a blanket mounted peripherally thereof; an impression cylinder; an image recorder for recording an image on the printing plate mounted peripherally of the plate cylinder; an ink feeder for feeding ink to the printing plate mounted peripherally of the plate cylinder; a plate cylinder gear disposed laterally of the plate cylinder to be rotatable therewith; a blanket cylinder gear disposed laterally of the blanket cylinder to be rotatable therewith and meshable with the plate cylinder gear; an impression cylinder gear disposed laterally of the impression cylinder to be rotatable therewith and meshable with the blanket cylinder gear; a blanket cylinder gear moving mechanism for moving the blanket cylinder gear between a printing position for meshing with the plate cylinder gear, and a platemaking position separated from the plate cylinder gear; a first motor connected to the plate cylinder gear through the blanket cylinder gear for synchronously rotating the plate cylinder, the blanket cylinder and the impression cylinder when the blanket cylinder gear is in the printing position; and a second motor connected to the plate cylinder gear for rotating the plate cylinder when the blanket cylinder gear is in the platemaking position.

This printing apparatus includes the blanket cylinder gear moving mechanism for moving the blanket cylinder gear between a printing position for meshing with the plate cylinder gear, and a platemaking position separated from the plate cylinder gear. Thus, the printing apparatus, though simple in construction, can record and print images with high precision.

In a preferred embodiment, the blanket cylinder gear moving mechanism is arranged to move the blanket cylinder gear between the printing position for meshing with the impression cylinder gear and the plate cylinder gear, and the platemaking position for meshing with the impression cylinder gear but separated from the plate cylinder gear.

Preferably, the blanket cylinder gear is fixed laterally of the blanket cylinder, the blanket cylinder gear moving mechanism moving the blanket cylinder gear along with the blanket cylinder between the printing position and the platemaking position.

The second motor may be connected to the plate cylinder gear through a clutch, the plate cylinder having a rotary encoder for detecting rotational positions thereof at platemaking time.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
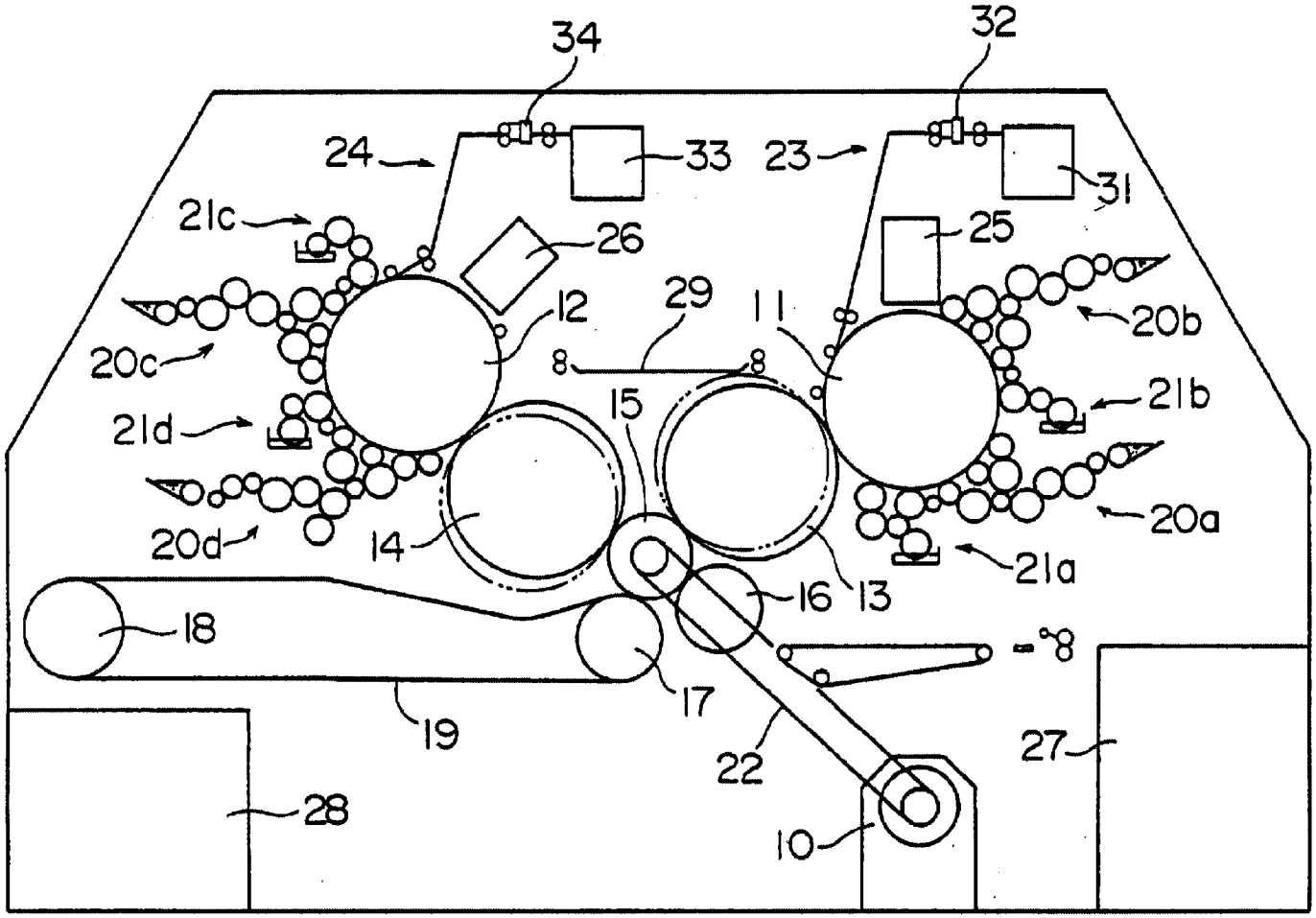
FIG. 1 is a schematic view of a printing apparatus according to this invention.

Embodiments of this invention will be described hereinafter with reference to the drawings. FIG. 1 is a schematic view of a printing apparatus according to the invention.

This printing apparatus makes printing plates by recording and developing images on blank plates mounted on first and second plate cylinders 11 and 12, feeds inks to the plates having the images recorded thereon, and transfers the inks from the plates through first and second blanket cylinders 13 and 14 to printing paper mounted on an impression cylinder 15, thereby printing the images on the printing paper.

The first blanket cylinder 13 is contactable with the first plate cylinder 11, while the second blanket cylinder 14 is contactable with the second plate cylinder 12. The impression cylinder 15 is contactable with the first and second blanket cylinders 13 and 14 in different positions. The apparatus further includes a paper feed cylinder 16 for transferring printing paper supplied from a paper magazine 27 to the impression cylinder 15, a paper discharge cylinder 17 with chains 19 wound thereon and on a sprocket 18 for discharging printed paper from the impression cylinder 15 to a paper discharge station 28.

The impression cylinder 15 contactable by the first and second blanket cylinders 13 and 14 has half the diameter of the first and second plate cylinders 11 and 12 and the first and second blanket cylinders 13 and 14. Further, the impression cylinder 15 has a gripper, not shown, for holding and transporting the forward end of printing paper.

The paper feed cylinder 16 disposed adjacent the impression cylinder 15 has the same diameter as the impression cylinder 15. The paper feed cylinder 16 has a gripper, not shown, for holding and transporting the forward end of each sheet of printing paper fed from the paper magazine 27. When the printing paper is transferred from the feed cylinder 16 to the impression cylinder 15, the gripper of the impression cylinder 15 holds the forward end of the printing paper which has been held by the gripper of the feed cylinder 16.

The paper discharge cylinder 17 disposed adjacent the impression cylinder 15 has the same diameter as the impression cylinder 15. The discharge cylinder 17 has a pair of chains 19 wound around opposite ends thereof. The chains 19 are interconnected by coupling members, not shown, having grippers arranged thereon. When the impression cylinder 15 transfers the printing paper to the discharge cylinder 17, one of the grippers of the discharge cylinder 17 holds the forward end of the printing paper having been held by the gripper of the impression cylinder 15. With movement of the chains 19, the printing paper is discharged to the paper discharge station 28.

The impression cylinder 15 is connected to a drive motor 10 through a belt 22. The impression cylinder 15, feed cylinder 16, discharge cylinder 17 and first and second blanket cylinders 13 and 14 are connected to one another through gears attached to ends thereof, respectively. Further, the first blanket cylinder 13 is connected to the first plate cylinder 11, and the second blanket cylinder 14 to the second plate cylinder 12 by gears attached to ends thereof, respectively, when the first and second blanket cylinders 13 and 14 are in printing positions described hereinafter. Thus, the drive motor 10 rotates the feed cylinder 16, impression cylinder 15, discharge cylinder 17, first and second blanket cylinders 13 and 14, and first and second plate cylinders 11 and 12 synchronously with one another.

The first plate cylinder 11 has, arranged therearound, an ink feeder 20*a* for feeding black ink (K), for example, to a plate, an ink feeder 20*b* for feeding magenta ink (M) to a different plate, and dampening water feeders 21*a* and 21*b* for feeding dampening water to the plates. The second plate cylinder 12 has, arranged therearound, an ink feeder 20*c* for feeding cyan ink (C) to a plate, an ink feeder 20*d* for feeding yellow ink (Y) to a different plate, and dampening water feeders 21*c* and 21*d* for feeding dampening water to the plates.

Further, the first and second plate cylinders 11 and 12 have, arranged therearound, a plate feeder 23 for feeding plates to the periphery of the first plate cylinder 11, a plate feeder 24 for feeding plates to the periphery of the second plate cylinder 12, an image recorder 25 for recording images on the plates mounted peripherally of the first plate cylinder 11, an image recorder 26 for recording images on the plates mounted peripherally of the second plate cylinder 12, and a plate discharger 29 common to the first and second plate cylinders 11 and 12.

In the printing apparatus having the above construction, a printing plate drawn from a supply cassette 31 in the plate feeder 23 is cut to a predetermined size by a cutter 32. A forward end of the printing plate cut into sheet form is guided by guide rollers and a guide member, and clamped by a clamping jaw on the first plate cylinder 11. Then, the first plate cylinder 11 is rotated by a motor 43 described hereinafter, whereby the printing plate is wound peripherally of the first plate cylinder 11. The rear end of the printing plate is clamped by a different clamping jaw. While, in this state, the first plate cylinder 11 is rotated at low speed by the motor 43, the image recorder 25 irradiates the surface of the plate mounted peripherally of the first plate cylinder 11 with a modulated laser beam for recording an image thereon.

Similarly, a printing plate drawn from a supply cassette 33 in the plate feeder 24 is cut to a predetermined size by a cutter 34. A forward end of the printing plate cut into sheet form is guided by guide rollers and a guide member, and clamped by a clamping jaw on the second plate cylinder 12. Then, the second plate cylinder 12 is rotated by a motor 43 described hereinafter, whereby the printing plate is wound peripherally of the second plate cylinder 12. The rear end of the printing plate is clamped by a different clamping jaw. While, in this state, the second plate cylinder 12 is rotated at low speed by the motor 43, the image recorder 26 irradiates the surface of the plate mounted peripherally of the second plate cylinder 12 with a modulated laser beam for recording an image thereon.

The first plate cylinder 11 holds two printing plates mounted peripherally thereof, one for printing in the black ink and the other in the magenta ink. These two printing plates are arranged in evenly separated positions, i.e. in positions separated from each other by 180 degrees. The image recorder 25 records images on these printing plates. Similarly, the second plate cylinder 12 holds two printing plates mounted peripherally thereof, one for printing in the cyan ink and the other in the yellow ink. These two printing plates also are arranged in evenly separated positions. The image recorder 26 records images on these printing plates to complete a platemaking process.

The platemaking process is followed by a printing process for printing the printing paper with the plates mounted on the first and second plate cylinders 11 and 12. The printing process is carried out as follows.

First, each dampening water feeder 21 and each ink feeder 20 are placed in contact with only a corresponding one of the plates mounted on the first and second plate cylinders 11 and 12. Consequently, dampening water and inks are fed to the plates from the corresponding water feeders 21 and ink feeders 20, respectively. The inks fed to the plates are transferred to the first and second blanket cylinders 13 and 14, respectively.

Then, the printing paper is fed to the paper feed cylinder 16. The printing paper is subsequently passed from the paper feed cylinder 16 to the impression cylinder 15. The impression cylinder 15 continues to rotate in this state. Since the impression cylinder 15 has half the diameter of the first and second plate cylinders 11 and 12 and the first and second blanket cylinders 13 and 14, the black and cyan inks are transferred to the printing paper wrapped around the impression cylinder 15 in its first rotation, and the magenta and yellow inks in its second rotation.

The forward end of the printing paper printed in the four colors is passed from the impression cylinder 15 to the paper discharge cylinder 17. This printing paper is transported by the pair of chains 19 to the paper discharge station 28 to be discharged therein.

Upon completion of the printing process, the plates used in the printing are discharged to the plate discharger 29. Then, the first and second blanket cylinders 13 and 14 are cleaned by a blanket cleaning unit, not shown, to complete the printing process.

In this printing apparatus, in order to record images with high precision at platemaking time, it is necessary to rotate each of the first and second plate cylinders 11 and 12 by the motor 43 different from the motor 10 for rotating the paper feed cylinder 16, impression cylinder 15, paper discharge cylinder 17, first and second blanket cylinders 13 and 14 and first and second plate cylinders 11 and 12 synchronously with one another at printing time. For this reason, this printing apparatus employs a blanket cylinder gear moving mechanism. Specifically, each of the first plate cylinder 11 and second plate cylinder 12 has a plate cylinder gear 41 fixed to a side thereof, and each of the first blanket cylinder 13 and second blanket cylinder 14 has a blanket cylinder gear 42 fixed to a side thereof. The blanket cylinder gear moving mechanism is operable to move the blanket cylinder gear 42 between a printing position for meshing with the plate cylinder gear 41, and a platemaking position separated from the plate cylinder gear 41.

Figure 2:
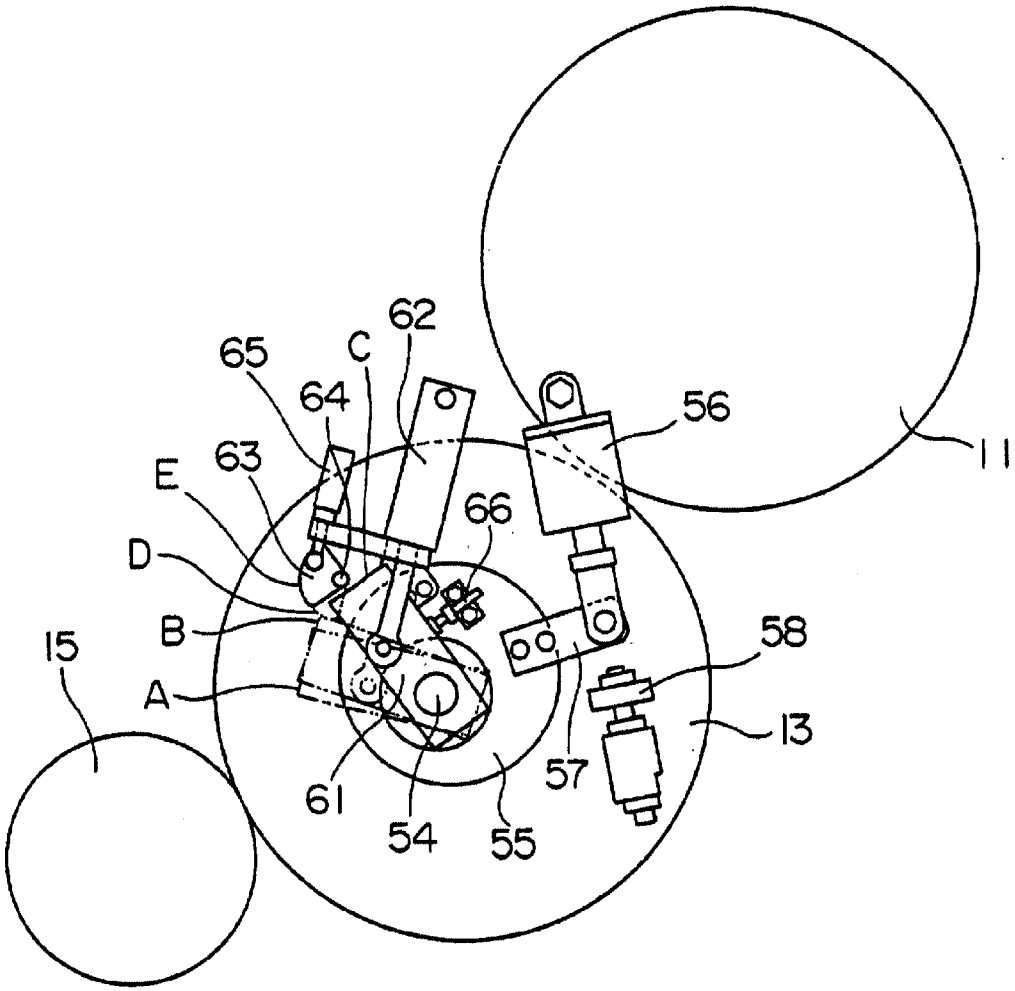
FIG. 2 is a side view showing the construction of a blanket cylinder gear moving mechanism in a first embodiment of the invention.
Figure 3:
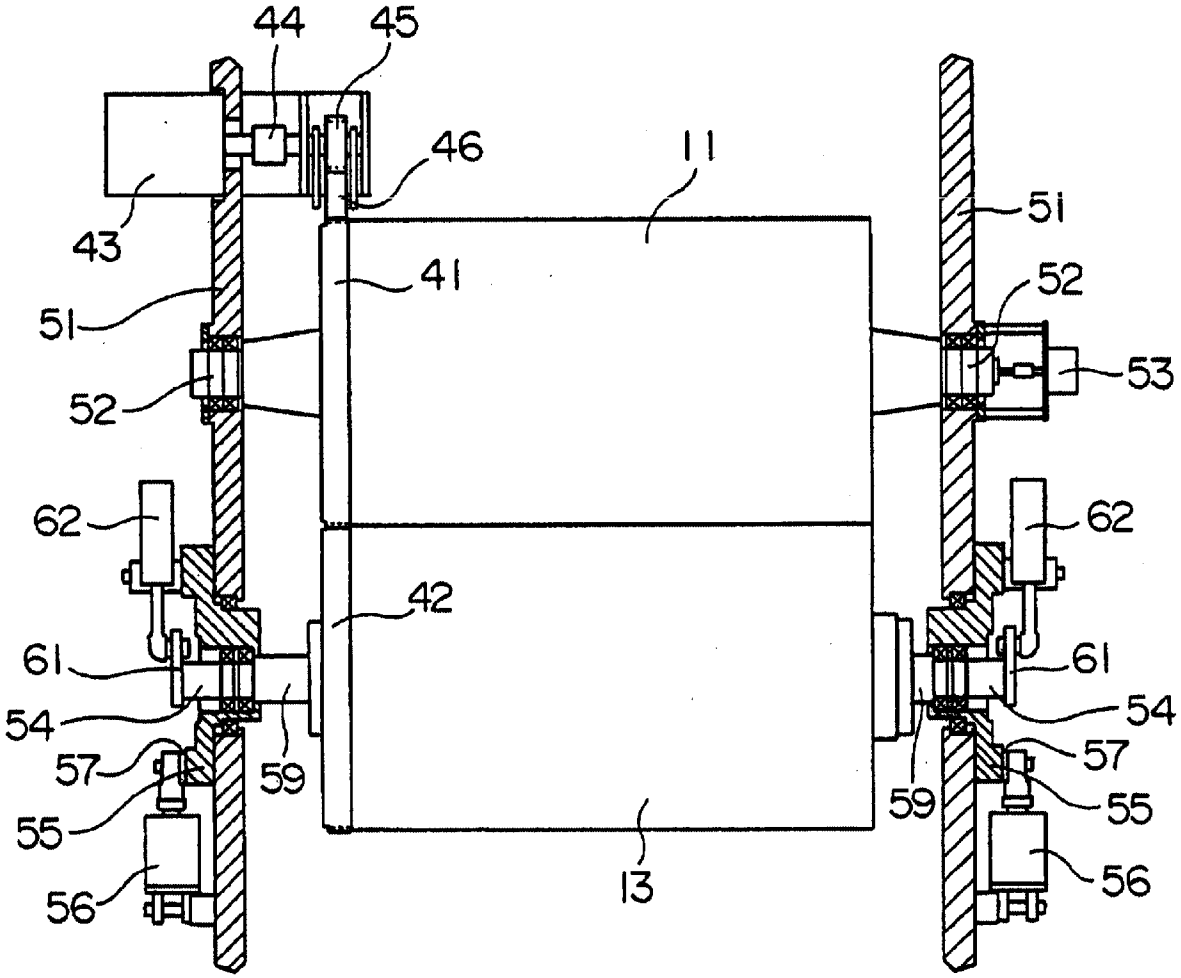
FIG. 3 is a development showing a principal portion of the blanket cylinder gear moving mechanism in the first embodiment.

The construction of this blanket cylinder gear moving mechanism will be described hereinafter. FIG. 2 is a side view showing the construction of the blanket cylinder gear moving mechanism in a first embodiment of the invention. FIG. 3 is a development showing a principal portion of this mechanism.

While, in the following description, reference is made to the first plate cylinder 11 and first blanket cylinder 13, the same construction is employed for the second plate cylinder 12 and second blanket cylinder 14. FIG. 2 shows the first blanket cylinder 13 and blanket cylinder gear 42 placed in the platemaking position described hereinafter. FIG. 3 shows the first blanket cylinder 13 and blanket cylinder gear 42 placed in the printing position described hereinafter.

As shown in FIG. 3, the first plate cylinder 11 is rotatable about axes 52 supported by a pair of side plates 51. The plate cylinder gear 41 is fixed to a side of the first plate cylinder 11 to be rotatable with the first plate cylinder 11. One of the axes 52 of the first plate cylinder 11 is connected to a rotary encoder 53 for detecting a rotational position of the first plate cylinder 11.

The motor 43 is mounted on one of the side plates 51. The motor 43 has a drive shaft connected to a drive gear 45 through a clutch 44. The drive gear 45 is connected to the plate cylinder gear 41 through an idler gear 46. At image-recording time, the first plate cylinder 11 is rotated by the motor 43, with first blanket cylinder 13 and blanket cylinder gear 42 placed in the platemaking position described hereinafter.

As shown in FIGS. 2 and 3, the first blanket cylinder 13 has a support shaft 59 connected to eccentric shafts 54 supported by a pair of eccentric bearings 55. The first blanket cylinder 13 has bearings mounted inside for supporting the first blanket cylinder 13 to be rotatable relative to the support shaft 59. The support shaft 59 of the first blanket cylinder 13 has an axis thereof out of alignment with the axis of the eccentric shafts 54. The support shaft 59 and eccentric shafts 54 are offset relative to each other by a fixed amount.

The blanket cylinder gear 42 is fixed to a side of the first blanket cylinder 13 to be rotatable with the blanket cylinder gear 42. The blanket cylinder gear 42 meshes with the plate cylinder gear 41 when the first blanket cylinder 13 and blanket cylinder gear 42 are in the printing position described hereinafter. The impression cylinder 15 has an impression cylinder gear fixed to a side thereof to be rotatable with the impression cylinder 15. The impression cylinder gear is meshed with the blanket cylinder gear 42.

The pair of eccentric bearings 55 are rotatably supported by the pair of side plates 51. The eccentric bearings 55 have an axis of rotation offset from the axis of the support shaft 59 of the first blanket cylinder 13. Each eccentric bearing 55 has a drive plate 57 fixed thereto and connected to a drive rod of an actuator 56 fixed at one end to the side plate 51. Thus, the pair of eccentric bearings 55 are rotatable by the pair of actuators 56. When the pair of eccentric bearings 55 are rotated, the support shaft 59 of the first blanket cylinder 13 is displaced by an amount corresponding to the amount of eccentricity.

Thus, by setting the amount of eccentricity of the eccentric bearings 55 beforehand, the first blanket cylinder 13 may be moved between a position in which the blanket mounted peripherally of the first blanket cylinder 13 contacts the surface of the impression cylinder 15, and a position in which the blanket is separated from the surface of the impression cylinder 15. The moving mechanism including the eccentric bearings 55 and actuators 56 for moving the first blanket cylinder 13 acts as a printing pressure applying mechanism for moving the first blanket cylinder 13 between the position in which the blanket mounted peripherally of the first blanket cylinder 13 contacts the surface of the impression cylinder 15, and the position in which the blanket is separated from the surface of the impression cylinder 15.

When the blanket mounted peripherally of the first blanket cylinder 13 is separated from the surface of the impression cylinder 15, the surface of the blanket and the surface of the impression cylinder 15 are spaced from each other by an adjustable distance of approximately 0.6 mm, for example. When the blanket mounted peripherally of the first blanket cylinder 13 is in contact with the surface of the impression cylinder 15, a pressure of contact therebetween is adjusted beforehand to a required printing pressure. This printing pressure adjustment is carried out by means of stoppers 58.

A movable plate 61 is fixed to a distal end of each eccentric shaft 54. The movable plate 61 is connected to a drive rod of an actuator 62 fixed at one end to the side plate 51. Thus, the pair of eccentric shafts 54 are rotatable by the pair of actuators 62. Since the support shaft 59 of the first blanket cylinder 13 and the eccentric shafts 54 are offset relative to each other by a fixed amount, the rotation of the eccentric shafts 54 displaces the support shaft 59 of the first blanket cylinder 13 by an amount corresponding to the amount of offset. The amount of displacement is proportional to the amount of movement of the movable plates 61.

A movement restricting cam 63 is disposed adjacent an end of each movable plate 61 for restricting movement of the movable plate 61. The movement restricting cam 63 is movable by an actuator 65 about an axis 64 between a position E shown in a solid line and a position D shown in a phantom line in FIG. 2. When the movement restricting cam 63 is in the position E shown in the solid line, the movable plate 61 is movable between a position A shown in a phantom line and a position C shown in a solid line. When the movement restricting cam 63 is in the position D shown in the phantom line, the movable plate 61 is movable between the position A shown in the phantom line and a position B shown in a phantom line. Numeral 66 in FIG. 2 denotes a stopper for limiting movement of the movable plate 61.

When the movable plate 61 is placed in the position A shown in the phantom line in FIG. 2, the blanket mounted peripherally of the first blanket cylinder 13 contacts the printing plates mounted peripherally of the first plate cylinder 11. When the movable plate 61 is placed in the position B shown in the phantom line in FIG. 2, the blanket mounted peripherally of the first blanket cylinder 13 is spaced by a distance of approximately 0.3 mm, for example, from the printing plates mounted peripherally of the first plate cylinder 11. In the above two cases, the first blanket cylinder 13 and blanket cylinder gear 42 are in the printing position having the blanket cylinder gear 42 meshed with the plate cylinder gear 41 and with the impression cylinder gear.

When the movable plate 61 is placed in the position C shown in the solid line in FIG. 2, the blanket mounted peripherally of the first blanket cylinder 13 is further spaced from the printing plates mounted peripherally of the first plate cylinder 11. In this case, the first blanket cylinder 13 and blanket cylinder gear 42 are in the platemaking position having the blanket cylinder gear 42 out of mesh with the plate cylinder gear 41. In this case also, the blanket cylinder gear 42 remains meshed with the impression cylinder gear.

The moving mechanism including the movable plates 61 and actuators 62 for moving the first blanket cylinder 13 acts as a plate pressing mechanism for moving the first blanket cylinder 13 between the position in which the blanket mounted peripherally of the first blanket cylinder 13 contacts the printing plates mounted peripherally of the first plate cylinder 15, and the position in which the blanket is separated from the printing plates mounted peripherally of the first plate cylinder 15.

With the blanket cylinder gear moving mechanism having the above construction, at printing time, each movement restricting cam 63 is placed in the position D shown in the phantom line in FIG. 2, and each movable plate 61 is placed by the actuator 62 in the position A shown in the phantom line or the position B shown in the phantom line in FIG. 2. In this state, the blanket cylinder gear 42 is meshed with the plate cylinder gear 41, and the first plate cylinder 11 is rotated by the drive motor 10 synchronously with the first blanket cylinder 13, impression cylinder 15, paper feed cylinder 16, paper discharge cylinder 17, second blanket cylinder 14 and second plate cylinder 12. In this state, the motor 43 is freed from influences of the rotation of the first plate cylinder 11 by operation of the clutch 44.

At image-recording time, on the other hand, each movement restricting cam 63 is placed in the position E shown in the solid line in FIG. 2, and each movable plate 61 is placed by the actuator 62 in the position shown in the solid line C in FIG. 2. In this state, the blanket cylinder gear 42 is out of mesh with the plate cylinder gear 41. The motor 43 drives the plate cylinder gear 41 through the drive gear 45 and idler gear 46 to rotate the first plate cylinder 11 at low speed. The image recorder 25 shown in FIG. 1 irradiates the plates mounted peripherally of the first plate cylinder 11 with modulated laser beams for recording images thereon.

At platemaking time, the printing apparatus having the above construction can operate the motor 43 to rotate the plate cylinder gear 41 independently as separated from the drive system of the printing apparatus. Thus, the printing apparatus, though simple in construction, can record and print images with high precision.

At image-recording time, the rotary encoder 53 constantly detects rotational positions of the first plate cylinder 11. Thus, even when the plate cylinder gear 41 and blanket cylinder gear 42 are once placed out of mesh, no phase shift takes place, and the image recording accuracy may be maintained high.

Since the first plate cylinder 11 and first blanket cylinder 13 are independently rotatable, an operation for cleaning the first blanket cylinder 13 may be carried out at image-recording time using the first plate cylinder 11.

Figure 4:
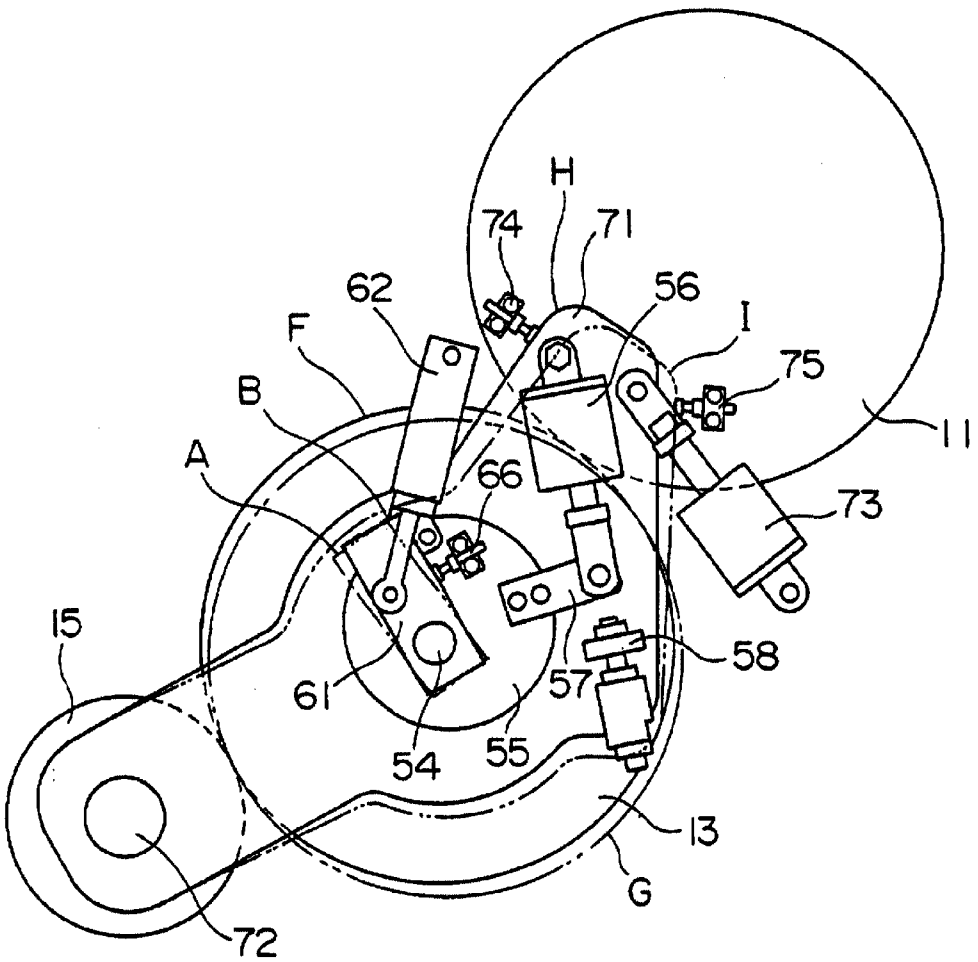
FIG. 4 is a side view showing the construction of a blanket cylinder gear moving mechanism in a second embodiment of the invention.
Figure 5:
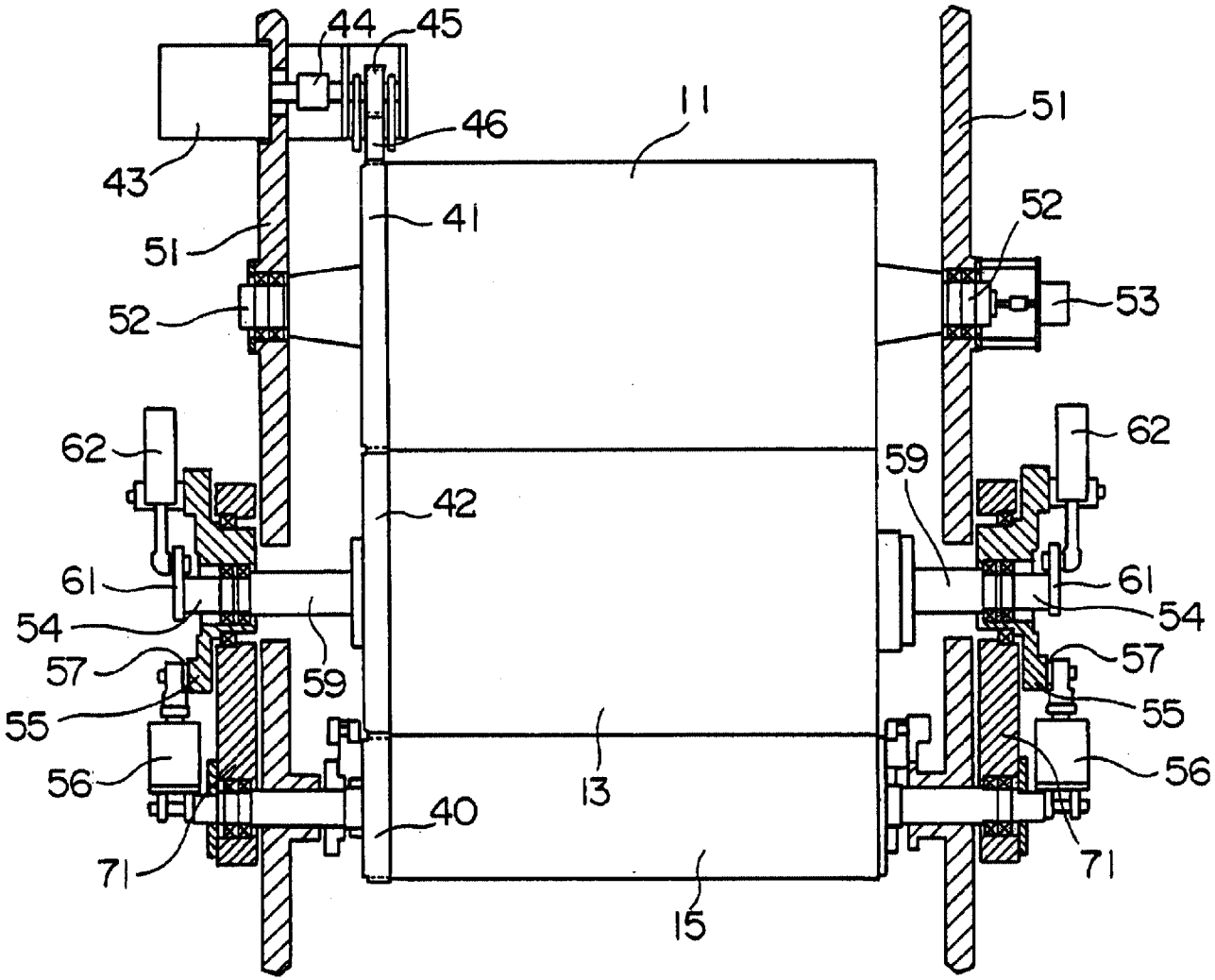
FIG. 5 is a development showing a principal portion of the blanket cylinder gear moving mechanism in the second embodiment.

A blanket cylinder gear moving mechanism in another embodiment will be described next. FIG. 4 is a side view showing the construction of a blanket cylinder gear moving mechanism in a second embodiment of the invention. FIG. 5 is a development showing a principal portion of this mechanism.

In the blanket cylinder gear moving mechanism in the first embodiment described above, the plate pressing mechanism increases a stroke of movement of the first blanket cylinder 13 for moving the first blanket cylinder 13 and blanket cylinder gear 42 between the printing position and platemaking position. The blanket cylinder gear moving mechanism in the second embodiment includes a pair of swing arms 71 supporting the first blanket cylinder 13, plate pressing mechanism and printing pressure applying mechanism. The swing arms 71 are swingable about the axis of rotation of the impression cylinder 15 to move the first blanket cylinder 13 and blanket cylinder gear 42 between the printing position and platemaking position.

In the following description, like reference numerals are used to identify like parts which are the same as in the first embodiment and will not particularly be described again.

In the blanket cylinder gear moving mechanism in the second embodiment, the eccentric bearings 55, actuators 56 and stoppers 58 and 66 are arranged on the pair of swing arms 71. Each swing arm 71 is connected to a drive rod of an actuator 73 fixed at an end thereof to the side plate 51, to be swingable about a shaft 72 of the impression cylinder 15. Numeral 40 in FIG. 5 denotes an impression cylinder gear fixed to a side of the impression cylinder 15.

With the blanket cylinder gear moving mechanism in the second embodiment, at printing time, each swing arm 71 is placed in a position H shown in solid lines in FIG. 4, and each movable plate 61 is placed by the actuator 62 in a position A shown in a phantom line or a position B shown in a phantom line in FIG. 4. In this state, the blanket cylinder gear 42 is meshed with the plate cylinder gear 41 and with the impression cylinder gear 40, and the first plate cylinder 11 is rotated by the drive motor 10 synchronously with the first blanket cylinder 13, impression cylinder 15, paper feed cylinder 16, paper discharge cylinder 17, second blanket cylinder 14 and second plate cylinder 12. In this state, the motor 43 is freed from influences of the rotation of the first plate cylinder 11 by operation of the clutch 44.

At image-recording time, each swing arm 71 moves from the position H shown in the solid lines to a position I shown in phantom lines in FIG. 4. As a result, the first blanket cylinder 13 moves from a position F shown in solid lines to a position G shown in phantom lines in FIG. 4. In this state, the blanket cylinder gear 42 is out of mesh with the plate cylinder gear 41 while remaining meshed with the impression cylinder gear 40. The motor 43 drives the plate cylinder gear 41 through the drive gear 45 and idler gear 46 to rotate the first plate cylinder 11 at low speed. The image recorder 25 shown in FIG. 1 irradiates the plates mounted peripherally of the first plate cylinder 11 with modulated laser beams for recording images thereon.

Figure 6:
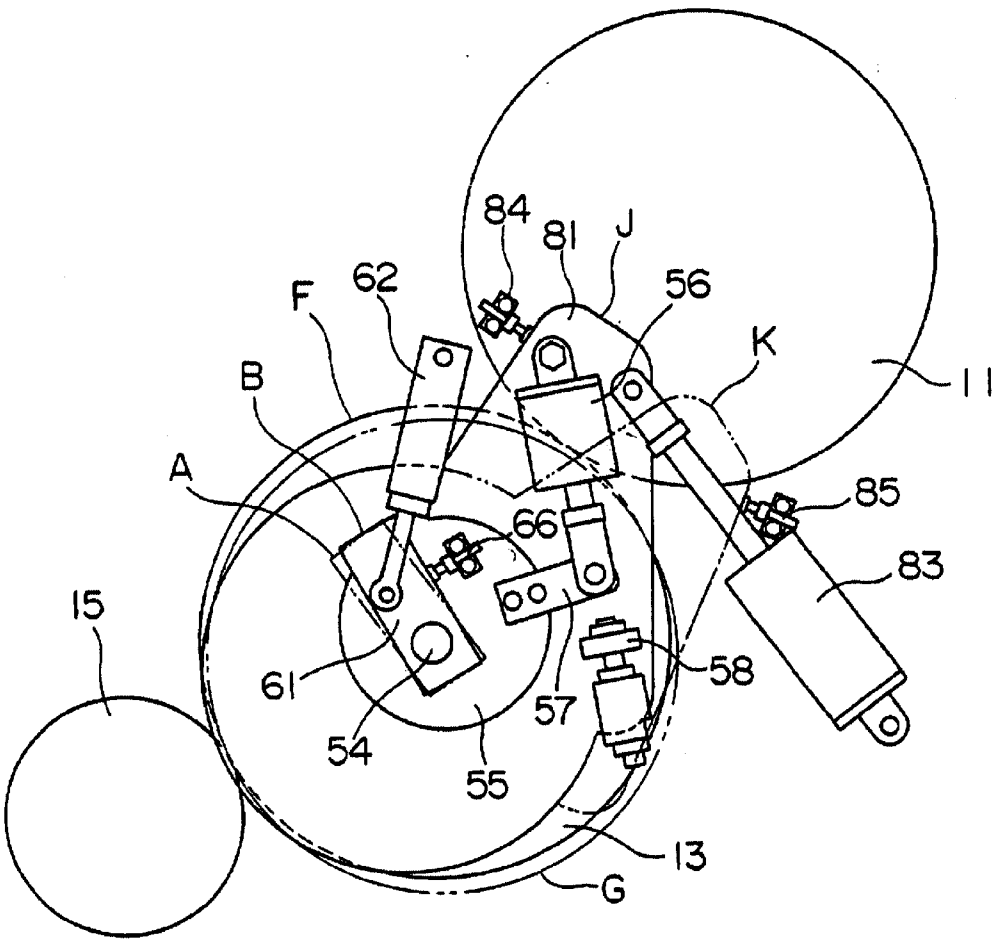
FIG. 6 is a side view showing the construction of a blanket cylinder gear moving mechanism in a third embodiment of the invention.
Figure 7:
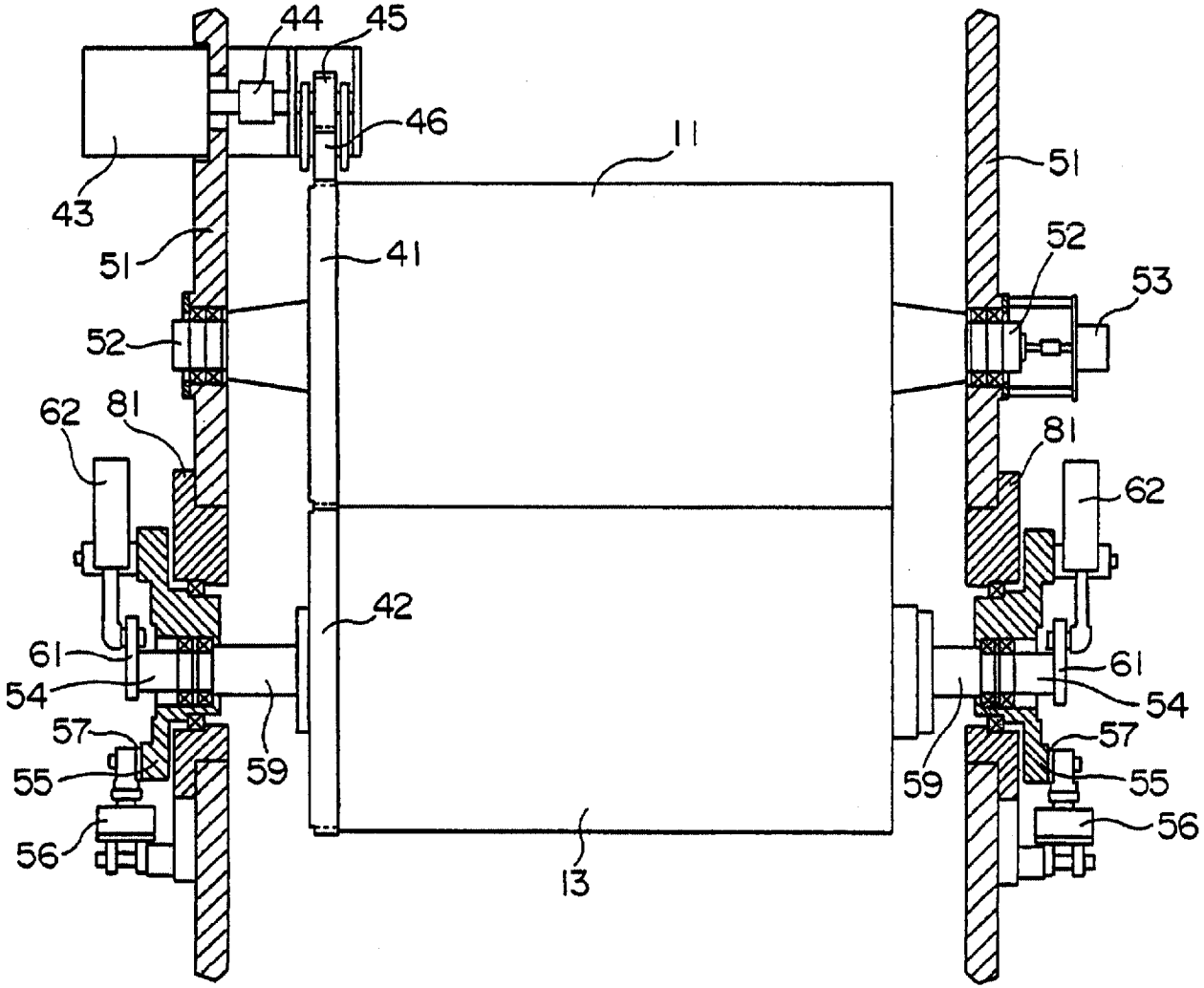
FIG. 7 is a development showing a principal portion of the blanket cylinder gear moving mechanism in the third embodiment.

A blanket cylinder gear moving mechanism in a further embodiment will be described next. FIG. 6 is a side view showing the construction of a blanket cylinder gear moving mechanism in a third embodiment of the invention. FIG. 7 is a development showing a principal portion of this mechanism.

In the blanket cylinder gear moving mechanism in the first embodiment described hereinbefore, the plate pressing mechanism increases a stroke of movement of the first blanket cylinder 13 for moving the first blanket cylinder 13 and blanket cylinder gear 42 between the printing position and platemaking position. The blanket cylinder gear moving mechanism in the third embodiment includes a pair of eccentric flanges 81 supporting the first blanket cylinder 13, plate pressing mechanism and printing pressure mechanism. The eccentric flanges 81 are rotatable to move the first blanket cylinder 13 and blanket cylinder gear 42 between the printing position and platemaking position.

In the following description, like reference numerals are used to identify like parts which are the same as in the first and second embodiments and will not particularly be described again.

In the blanket cylinder gear moving mechanism in the third embodiment, the eccentric bearings 55, actuators 56 and stoppers 58 and 66 are arranged on the pair of eccentric flanges 81. Each eccentric flange 81 is connected to a drive rod of an actuator 83 fixed at an end thereof to the side plate 51, to be rotatable within an opening formed in the side plate 51. The eccentric flanges 81 have an axis of rotation offset from the axis of the support shaft 59 of the first blanket cylinder 13. Thus, the first blanket cylinder 13 is shifted when the eccentric flanges 81 are rotated by the actuators 56.

With the blanket cylinder gear moving mechanism in the third embodiment, at printing time, each eccentric flange 81 is placed in a position J shown in a solid line in FIG. 6, and each movable plate 61 is placed by the actuator 62 in a position A shown in a phantom line or a position B shown in a phantom line in FIG. 6. In this state, the blanket cylinder gear 42 is meshed with the plate cylinder gear 41 and with the impression cylinder gear 40, and the first plate cylinder 11 is rotated by the drive motor 10 synchronously with the first blanket cylinder 13, impression cylinder 15, paper feed cylinder 16, paper discharge cylinder 17, second blanket cylinder 14 and second plate cylinder 12. In this state, the motor 43 is freed from influences of the rotation of the first plate cylinder 11 by operation of the clutch 44.

At image-recording time, each eccentric flange 81 moves from the position J shown in the solid line to a position K shown in a phantom line in FIG. 6. As a result, the first blanket cylinder 13 moves from a position F shown in solid lines to a position G shown in phantom lines in FIG. 6. In this state, the blanket cylinder gear 42 is out of mesh with the plate cylinder gear 41 while remaining meshed with the impression cylinder gear 40. The motor 43 drives the plate cylinder gear 41 through the drive gear 45 and idler gear 46 to rotate the first plate cylinder 11 at low speed. The image recorder 25 shown in FIG. 1 irradiates the plates mounted peripherally of the first plate cylinder 11 with modulated laser beams for recording images thereon.

Figure 8:
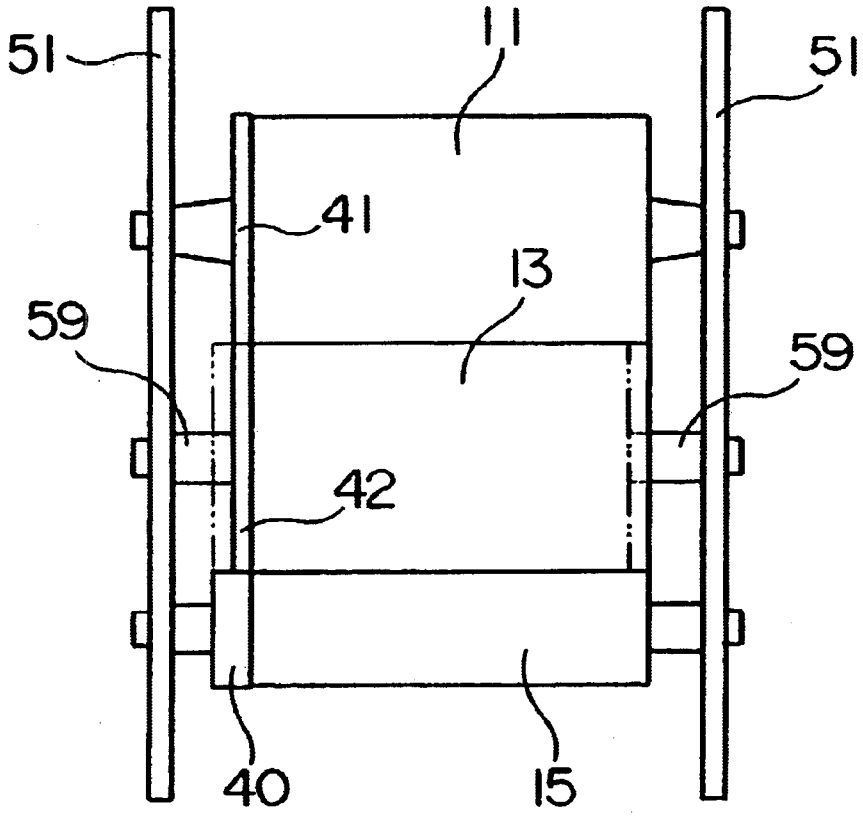
FIG. 8 is a schematic view showing the construction of a blanket cylinder gear moving mechanism in a fourth embodiment of the invention.
Figure 9:
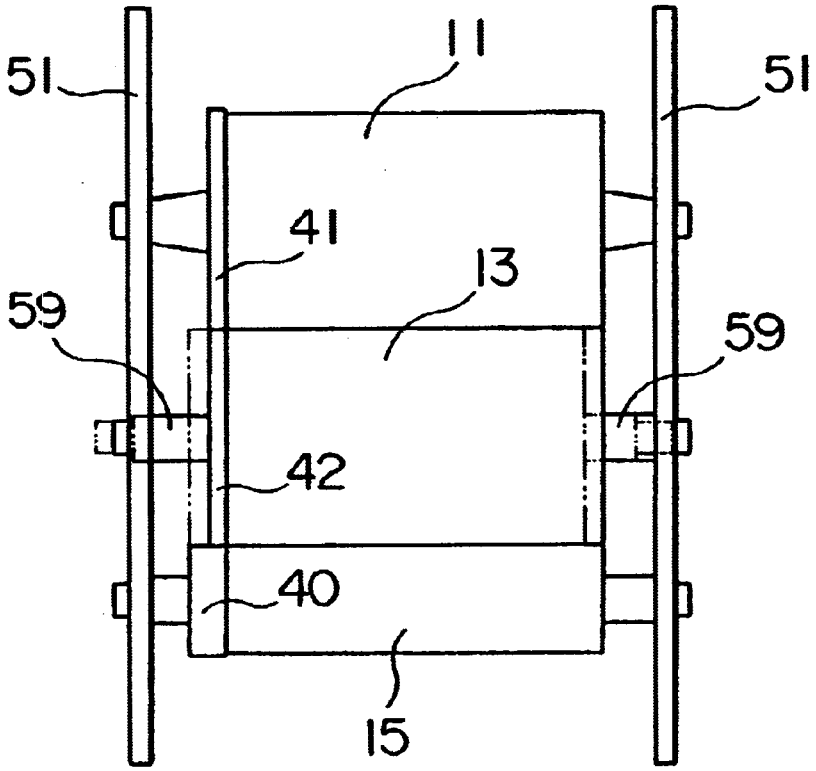
FIG. 9 is a schematic view showing the construction of a blanket cylinder gear moving mechanism in the fifth embodiment of the invention.
Figure 10:
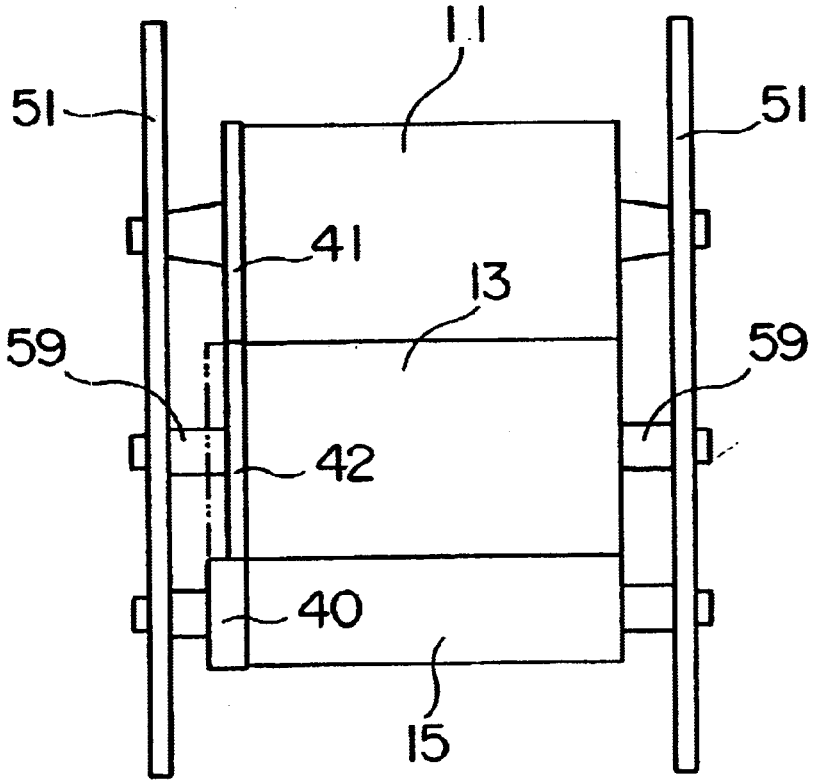
FIG. 10 is a schematic view showing the construction of a blanket cylinder gear moving mechanism in a sixth embodiment of the invention.

Blanket cylinder gear moving mechanisms in other embodiments will be described next. FIGS. 8 through 10 are side views showing the constructions of blanket cylinder gear moving mechanisms in a fourth to a sixth embodiments of the invention.

The blanket cylinder gear moving mechanisms in the first to third embodiments described hereinbefore move the first blanket cylinder 13 in directions perpendicular to the axis thereof to move the blanket cylinder gear 42 between the printing position for meshing with the plate cylinder gear 41 and the platemaking position separated from the plate cylinder gear 41. The blanket cylinder gear moving mechanisms in the fourth to sixth embodiments are constructed to move the blanket cylinder gear 42 in directions parallel to the axis of the first blanket cylinder 13, between a printing position for meshing with the plate cylinder gear 41 and a platemaking position separated from the plate cylinder gear 41.

In the following description, like reference numerals are used to identify like parts which are the same as in the first to third embodiments and will not particularly be described again.

In the fourth embodiment shown in FIG. 8, the first blanket cylinder 13 and blanket cylinder gear 42 are moved sideways relative to the support shaft 59 of the first blanket cylinder 13, to move the blanket cylinder gear 42 between a printing position for meshing with the plate cylinder gear 41 and a platemaking position separated from the plate cylinder gear 41. To avoid the blanket cylinder gear 42 moving out of mesh with the impression cylinder gear 40, the impression cylinder gear 40 in this embodiment is approximately twice as thick as in the first to third embodiments.

In the fifth embodiment shown in FIG. 9, the first blanket cylinder 13 and blanket cylinder gear 42 are moved sideways together with the support shaft 59 of the first blanket cylinder 13, to move the blanket cylinder gear 42 between a printing position for meshing with the plate cylinder gear 41 and a platemaking position separated from the plate cylinder gear 41. To avoid the blanket cylinder gear 42 moving out of mesh with the impression cylinder gear 40, the impression cylinder gear 40 in this embodiment also is approximately twice as thick as in the first to third embodiments.

In the sixth embodiment shown in FIG. 10, only blanket cylinder gear 42 is moved sideways relative to the first blanket cylinder 13, to move between a printing position for meshing with the plate cylinder gear 41 and a platemaking position separated from the plate cylinder gear 41. To avoid the blanket cylinder gear 42 moving out of mesh with the impression cylinder gear 40, the impression cylinder gear 40 in this embodiment also is approximately twice as thick as in the first to third embodiments.

In the above fourth to sixth embodiments also, at platemaking time, the motor 43 may be operated to rotate the plate cylinder gear 41 independently as separated from the drive system of the printing apparatus. Thus, the printing apparatus, though simple in construction, can record and print images with high precision.

The first to third embodiments have been described as using the eccentric blanket cylinder shaft as the plate pressing mechanism, and the eccentric bearings as the printing pressure applying mechanism. This invention should not be understood as being limited to such construction. For example, the plate pressing mechanism may use eccentric bearings or swing arms, or may also be a mechanism for disconnecting the plate cylinder gear 41 and blanket cylinder gear 42. The printing pressure applying mechanism may employ swing arms swingable about the axis of the plate cylinder, or about a position on or adjacent a line linking the axes of the plate cylinder and blanket cylinder.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2002-182724 filed in the Japanese Patent Office on Jun. 24, 2002, the entire disclosure of which is incorporated herein by reference.

What is claimed is:

1. A printing apparatus comprising:

a plate cylinder for supporting a printing plate as mounted peripherally thereof;

a blanket cylinder having a blanket mounted peripherally thereof;

an impression cylinder;

an image recorder for recording an image on said printing plate mounted peripherally of said plate cylinder;

an ink feeder for feeding ink to said printing plate mounted peripherally of said plate cylinder;

a plate cylinder gear disposed laterally of said plate cylinder to be rotatable therewith;

a blanket cylinder gear disposed laterally of said blanket cylinder to be rotatable therewith and meshable with said plate cylinder gear;

an impression cylinder gear disposed laterally of said impression cylinder to be rotatable therewith and meshable with said blanket cylinder gear;

a blanket cylinder gear moving mechanism for moving said blanket cylinder gear between a printing position for meshing with said plate cylinder gear, and a platemaking position separated from said plate cylinder gear;

a first motor connected to said plate cylinder gear through said blanket cylinder gear for synchronously rotating said plate cylinder, said blanket cylinder and said impression cylinder when said blanket cylinder gear is in said printing position; and a second motor connected to said plate cylinder gear for rotating said plate cylinder when said blanket cylinder gear is in said platemaking position.

2. A printing apparatus as defined in claim 1, wherein said blanket cylinder gear moving mechanism is arranged to move said blanket cylinder gear between said printing position for meshing with said impression cylinder gear and said plate cylinder gear, and said platemaking position for meshing with said impression cylinder gear but separated from said plate cylinder gear.

3. A printing apparatus as defined in claim 2, wherein said blanket cylinder gear is fixed laterally of said blanket cylinder, said blanket cylinder gear moving mechanism moving said blanket cylinder gear along with said blanket cylinder between said printing position and said platemaking position.

4. A printing apparatus as defined in claim 3, further comprising:

a plate pressing mechanism for moving said blanket cylinder between a position in which said blanket mounted peripherally of said blanket cylinder contacts said printing plate mounted peripherally of said plate cylinder, and a position in which said blanket mounted peripherally of said blanket cylinder is separated from said printing plate mounted peripherally of the plate cylinder; and a printing pressure applying mechanism for moving said blanket cylinder between a position in which said blanket mounted peripherally of said blanket cylinder contacts a surface of said impression cylinder, and a position in which the blanket mounted peripherally of said blanket cylinder is separated from said surface of said impression cylinder;

wherein said blanket cylinder gear moving mechanism is arranged to move said blanket cylinder between said printing position and said platemaking position by increasing a stroke of movement of said blanket cylinder by said plate pressing mechanism.

5. A printing apparatus as defined in claim 3, further comprising:

a plate pressing mechanism for moving said blanket cylinder between a position in which said blanket mounted peripherally of said blanket cylinder contacts said printing plate mounted peripherally of said plate cylinder, and a position in which said blanket mounted peripherally of said blanket cylinder is separated from said printing plate mounted peripherally of the plate cylinder; and a printing pressure applying mechanism for moving said blanket cylinder between a position in which said blanket mounted peripherally of said blanket cylinder contacts a surface of said impression cylinder, and a position in which the blanket mounted peripherally of said blanket cylinder is separated from said surface of said impression cylinder;

wherein said blanket cylinder gear moving mechanism is arranged to move said blanket cylinder between said printing position and said platemaking position by swinging, about an axis of rotation of said impression cylinder, of swing arms supporting said blanket cylinder, said plate pressing mechanism and said printing pressure applying mechanism.

6. A printing apparatus as defined in claim 3, further comprising:

a plate pressing mechanism for moving said blanket cylinder between a position in which said blanket mounted peripherally of said blanket cylinder contacts said printing plate mounted peripherally of said plate cylinder, and a position in which said blanket mounted peripherally of said blanket cylinder is separated from said printing plate mounted peripherally of the plate cylinder; and a printing pressure applying mechanism for moving said blanket cylinder between a position in which said blanket mounted peripherally of said blanket cylinder contacts a surface of said impression cylinder, and a position in which the blanket mounted peripherally of said blanket cylinder is separated from said surface of said impression cylinder;

wherein said blanket cylinder gear moving mechanism is arranged to move said blanket cylinder between said printing position and said platemaking position by rotation, about a position different from an axis of rotation of said blanket cylinder, of eccentric flanges supporting said blanket cylinder, said plate pressing mechanism and said printing pressure applying mechanism.

7. A printing apparatus as defined in claim 3, wherein said second motor is connected to said plate cylinder gear through a clutch, said plate cylinder having a rotary encoder for detecting rotational positions thereof at platemaking time.

* * * * *